United States Patent [19]

Rewitzer

[11] Patent Number: 4,526,095

[45] Date of Patent: Jul. 2, 1985

[54] PROCESS AND APPARATUS FOR THE AUTOMATIC DEPOSITING AND PRESSING OF CONTINUOUS TOWS

[75] Inventor: Siegfried Rewitzer, Ihrlerstein, Fed. Rep. of Germany

[73] Assignee: Hoechst Aktiengesellschaft, Fed. Rep. of Germany

[21] Appl. No.: 566,171

[22] Filed: Dec. 28, 1983

[30] Foreign Application Priority Data

Dec. 31, 1982 [DE] Fed. Rep. of Germany ..... 3248711

[51] Int. Cl.[3] ..... B30B 13/00

[52] U.S. Cl. ..... 100/39; 53/527; 53/591; 100/40; 100/70 R; 100/80; 100/95; 100/99; 100/193; 100/215; 100/229 R; 141/80; 141/314; 156/468; 177/146

[58] Field of Search ..... 100/76, 80, 81, 99, 100/40, 229 R, 39, 95, 94, 96, 215, 70 R, 193; 177/145, 146; 53/527, 591; 141/73, 71, 314, 80; 156/468

[56] References Cited

U.S. PATENT DOCUMENTS

| | | | |
|---|---|---|---|
| 2,924,444 | 2/1960 | Greenberger | 177/146 |
| 3,119,212 | 1/1964 | Zytka | 100/80 X |
| 3,371,597 | 3/1968 | Buchalla et al. . | |
| 4,179,773 | 12/1979 | Savageau . | |
| 4,224,780 | 9/1980 | Rewitzer . | |
| 4,318,264 | 3/1982 | Rewitzer . | |

FOREIGN PATENT DOCUMENTS

| | | |
|---|---|---|
| 0000881 | 8/1978 | European Pat. Off. . |
| 1239656 | 5/1967 | Fed. Rep. of Germany . |
| 1560158 | 6/1969 | Fed. Rep. of Germany . |
| 2252025 | 5/1974 | Fed. Rep. of Germany . |
| 3008839 | 9/1980 | Fed. Rep. of Germany . |
| 2911958 | 10/1980 | Fed. Rep. of Germany . |
| 2044304 | 10/1980 | United Kingdom . |
| 2065179 | 6/1981 | United Kingdom . |
| 2097026 | 10/1982 | United Kingdom . |

*Primary Examiner*—Billy J. Wilhite

*Attorney, Agent, or Firm*—Connolly and Hutz

[57] ABSTRACT

The invention relates to processes and devices for automatically depositing and pressing continuous tows in containers moved to and fro on a traversing device, wherein the start of the tow is transferred via a chute to a catch box on the container and is retained there, the container is weighed during each traversing movement because of the extension of a weighing platform and, when the nominal weight is reached, the fed tow is held and severed in a cutting and fixing device, the tow ends obtained are fixed and marked, and the tow end belonging to the deposited material and the start of the tow are introduced into the full container from the catch box.

7 Claims, 14 Drawing Figures

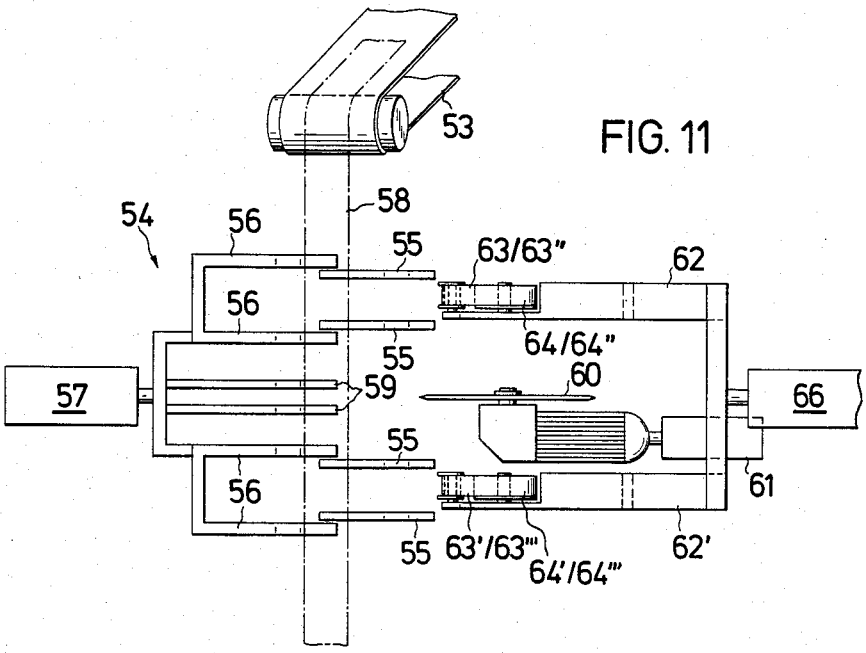
FIG. 11
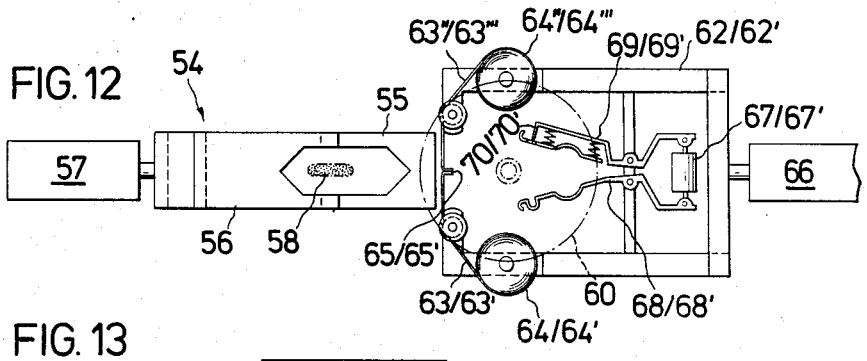
FIG. 12
FIG. 13
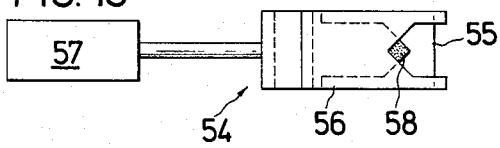
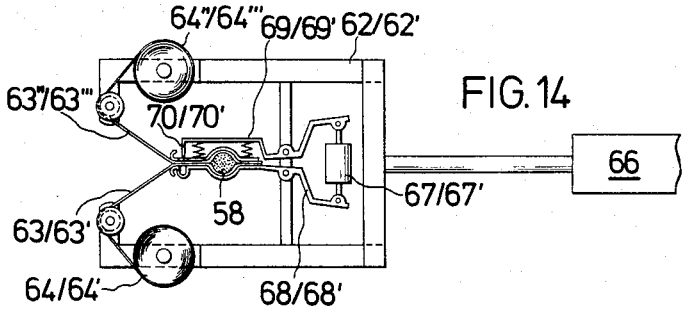
FIG. 14

PROCESS AND APPARATUS FOR THE AUTOMATIC DEPOSITING AND PRESSING OF CONTINUOUS TOWS

The invention relates to a process and an apparatus for automatically depositing and pressing continuous tows into containers.

It is known, for example from German Auslegeschrift No. 1,239,656, to deposit tows of this type into a container by means of a pivotable chute and at the same time to traverse the container on a traversing device transversely to the chute movement. Two press rams ensure that the material is compressed. They each act on the deposited material in the respective traversing end position. The width of the press rams should be somewhat more than half the container width, so that the press-in surfaces overlap in the center of the container. This method of depositing and pressing the tow material has proved successful. Apparatuses operating on this principle are to be found frequently in industry. They are used both for the final packaging of continuous tows of this type and recently to an increasing extent for depositing tows which are subsequently fed to a final press in which the material is further compressed and the actual packaging is then carried out in bale form and no longer, as was customary before, in disposable packs, such as, for example, cardboard boxes or the like. Repressing of the deposited tows in a final press or central press is described, for example, in European Patent Specification No. 0,000,881 and in German Offenlegungsschrift No. 2,911,958.

Even in this modern packaging method, the tow-depositing station with two press rams and a traversing deposit container still serves as the first stage in the packaging of tows of this type.

However, it is observed, when this process according to prior literature is carried out, that a plurality of monitoring functions and conditional steps are necessary during the operation of depositing devices of this type, in order to ensure that the process proceeds smoothly. This is especially true as regards the monitoring of the degree of filling of the traversing container and as regards securing the start and end of the tow and the transition from one container to the next. The degree of filling of the container is of considerable importance both for further processing by the tow manufacturer, that is to say, for example, final pressing in bale form, and for the subsequent processer who is concerned with being able to process specific quantities in a specific unit of time, the weights of the bales or packages differing as little as possible. All attempts to determine the weight of the deposited tow by means of its run length must be considered as having failed. It would be appropriate to use the run length as the measured variable only if no faults in the spinning operation have arisen during the entire deposition time, that is to say if the tow has the same denier from start to finish and if the run length of the material could be always measured under exactly the same tension. According to experience, however, the breakdown or change of jets or spinning positions often results in a shift in the effective tow thickness and consequently in a variation of the deposited quantity of tow in units of weight. A further difficulty arises in a change of the given denier value, since a new nominal value must always be set in advance to prevent overfilling of the container. Of the large number of possible faults which can lead to errors in fixing the filling weight when purely length is determined, fluctuations in crimp or crimp rigidity may also be mentioned. It would be possible to eliminate the faults arising as a result of this only if the crimp was completely drawn out of the tow material to be deposited, at least over a short distance. Such a procedure is not desirable from the point of view of the quality of the tow. However, any deposition under the constant tow tension results, when there are fluctuating crimp values, in different weight quantities per unit of length of the tow.

According to experience, the start and finish of the loading of a container represent sources of impairment of quality or faults, and sometimes even danger to the operating personnel. This is especially true when the tow-depositing station is located on a different story from the tow line. Here, information errors can lead to containers not being filled sufficiently or else, for example, the start of the tow not being adequately fixed Consequently, there was still the object of improving the apparatus known from German Auslegeschrift No. 1,239,656 and the associated process in such a way that it becomes possible to fill the container in as automatic a manner as possible, that exactly the optimum filling quantity is deposited in each container and that the start and end of the tow are deposited automatically in a definite manner, without danger to the operating personnel who can restrict themselves to monitoring the operation.

A way of achieving this object was found in the process and associated apparatus described below. They represent an inventive further development of the state of the art, for example according to German Auslegeschrift No. 1,239,656. In the same way as described there, the tow is deposited, in the present case also, by means of a pivotable chute into a container which is moved transversely to the movement of the chute from one end point to the other by means of a traversing device. When each end point is reached, the deposited tow material is pressed by press rams. In contrast to the state of the art, however, after an empty container has traveled into the depositing device, the start of the tow is first transferred into a catch box and is retained there during the entire deposition time. After the transfer, the container begins to execute the conventional traversing movements, and according to the invention the container is weighed each time on its path between the end points of the traversing movement. This is carried out by extending a weighing platform located in the traversing device. When a predetermined weight of the deposited tow material is reached, the further feed of the tow is stopped, the tow is severed in front of the chute and the individual filaments of the tow ends obtained are fixed and, if appropriate, marked. Subsequently, the end of the tow belonging to the tow deposited into the container is allowed to run into the container, and the start of the tow is also transferred into the full container from the catch box. Subsequently, the container filled in this way with pressed tow material is removed from the depositing device and replaced by an empty container.

The apparatus according to the invention therefore has, in comparison with the state of the art, at least the following special features: a weighing platform with weighing devices in the traversing device. This weighing platform can unimpededly follow the movements of the traversing device, but can furthermore be moved independently perpendicularly to the traversing movement.

The apparatus should also have a holding frame which is carried by a supporting device when containers are engaged into and removed from the depositing device, but which otherwise rests on the edge of the container located in the traversing device and can unimpededly follow the traversing movement of the container. Furthermore, there is a catch box with movement devices which is mounted movably on the holding frame, has a closable cover and can be brought by means of special movement devices into various positions relative to the container and the chute respectively.

The apparatus should preferably also have an automatically operating tow-cutting and fixing device which is located in front of the chute of the depositing device and which has gripping devices by means of which the tow can be clamped at several times, one behind the other and a movable cutting device and two fixing devices which make it possible to fix the individual filaments of the tow ends by winding something round them, gluing something round them or the like.

Preferred embodiments of the process and of the apparatus are the subjects of the individual sub-claims.

To illustrate the invention further, the process according to the invention will be dealt with first, and then the apparatus required according to the invention will subsequently be discussed in detail, and the principle according to the invention and a special embodiment of the apparatus used will be described in greater detail, particularly in relation to the attached drawings.

As already stated above, all attempts to determine the optimum degree of filling of the container by means of the tow length must be considered as having more or less failed. As already mentioned above, it is technically impossible to ensure that this tow always has the same number of filaments. In addition, there are unavoidable variations in tension in the crimped tow material, which are considered to be a further cause of fluctuations in the final weights of the tow material in the individual containers.

The difficulties associated with different degrees of filling become particularly evident when, after being deposited in the depositing device and pressed by the two press rams, the deposited tows are also to undergo subsequent final pressing in a central press. It is to be expected here, if the optimum degree of filling is exceeded, that final pressing cannot be completed without problems, since too much material is presented to the final press, because the predetermined degree of press or bale dimension can no longer be achieved by the central press.

It has been found that, in contrast to determining the tow length, determination of the tow weight in the container is a reliable criterion for the degree of filling and for unimpeded further processing. However, in contrast to determining the run length, the weight of the deposited tow can be determined only with difficulty, since appropriate weighing devices have to be constructed, in practice, in such a way that they can withstand the pressing force of the two press rams. A solution of this kind necessarily results in an inaccurate measuring system bedeviled with excessively large errors.

It is possible to reduce the error substantially if the weighing system does not have to withstand the pressing force of the press rams, but only the weight of the container and the deposited material. A restriction of this kind is possible if the actual weighing device, that is to say, for example, the load cells, can be swung out of the way during the pressing operation or is used only between the pressing operations.

This is achieved, according to the invention, by using a special weighing platform in the traversing device, which unimpededly follows the to-and-fro movement of the traversing device, but can freely move perpendicularly to this. When such a weighing platform is lifted, for example during the traversing movement, it then carries the container including its content and additional equipment fastened to it, during the traversing movement. Weighing devices mounted on the weighing platform can then measure the weight of the container and content and pass it on to appropriate control devices. In a preferred embodiment of the process, the weighing platform is lifted during the traversing movement by guiding the weighing platform on rollers which are guided over ramp-like structures. This arrangement makes it possible to measure the weight sufficiently frequently during the depositing operation without any intermediate interruption or any stopping of the container during the depositing operation. The weighing accuracy, that is to say adherence to the predetermined weight of the deposited tow material, can be exactly maintained at $\pm 0.2\%$ without difficulty, that is to say even when large containers are used or when subsequent final pressing with weights of, for example, 400 kg per unit is carried out it is easily possible to maintain the predetermined weight at an accuracy of $\pm 1$ kg.

Furthermore, the apparatus according to the invention includes a holding frame which can be lowered onto the container to be filled. When containers are introduced and discharged, this holding frame is mounted on a supporting device which can lower the holding frame onto the edge of the container in such a way that the holding frame is carried solely by the edge of the container and no longer by the supporting device. This holding frame has several functions. On the one hand, it ensures by means of clamping devices or the like that box bags introduced into the container cannot be shifted out of position even during the pressing operation. It is therefore necessary for the holding frame to have clamping devices on at least two sides. Furthermore, the holding frame is also the fastening point for the catch box. This catch box, including the associated movement devices, is fastened movably to the frame and serves for catching and retaining the start of the tow before the actual operation of filling the container. For this reason, it is advantageous if the catch box can be brought by means of movement devices into a special catching position in which it acquires approximately the same three-dimensional alignment as the pivoting chute in its end position. When the cover of the catch box is open it defines a catching position when the start of the tow can pass unimpeded into the catch box where suitable sensors can detect the presence of the start of the tow. This sensing is carried out, for example, by appropriate light-barrier systems.

When the start of the tow is located in the catch box, it is clamped in place as a result of the closing of the cover and is retained in this way. Advantageously, the catch box subsequently swings into a working position which makes contact with the chute impossible, and remains in this position during the entire depositing operation. Only after the depositing operation has ended is the catch box opened and the start of the tow dropped into the container and onto the deposited tow material. Subsequently, the holding frame is lifted again by the supporting device after the clamping device for the box bag has been released appropriately. The container is now free and can be conveyed out of the depositing device by means of suitable transport devices such as, for example, roller tracks or the like. The holding frame, including the catch box together with the associated movement and clamping devices, is an integral part of the container during the actual filling of the container and is consequently also weighed when the tare of the empty container is determined.

After the final weight has been reached, the tow must be severed and the individual filaments of the tow fixed in a suitable way to prevent them from shifting relative to one another. The tow can be severed by hand, and, as was customary previously, the individual filaments can also be fixed by hand by knotting the tow ends. However, it is easily possible to automate even this step by using a tow-cutting and -fixing device. For this purpose, it is necessary for the tow to be held at several points one behind the other and to be severed, when clamped, for example by a rotating knife. The individual filaments of the tow ends can be fixed, for example, by tying with a thread or gluing with a adhesive tape or the like. It is possible, at the same time, to carry out marking which enables the start of the tow and the tow end to be recognized clearly.

The apparatus according to the invention will be explained with reference to the attached Figures. In particular, the subjects of the Figures are as follows:

FIG. 11 shows a diagrammatic representation in a side view of a tow-cutting and -fixing device.

FIG. 12 is a plan view of a tow-cutting and -fixing device.

FIG. 13 shows in detail a plan view of the tow-clamping devices in the closed position, and FIG. 14 shows, in a similar way to FIG. 12, as a detail, a plan view of the fixing devices in the working position.

Figure 1:
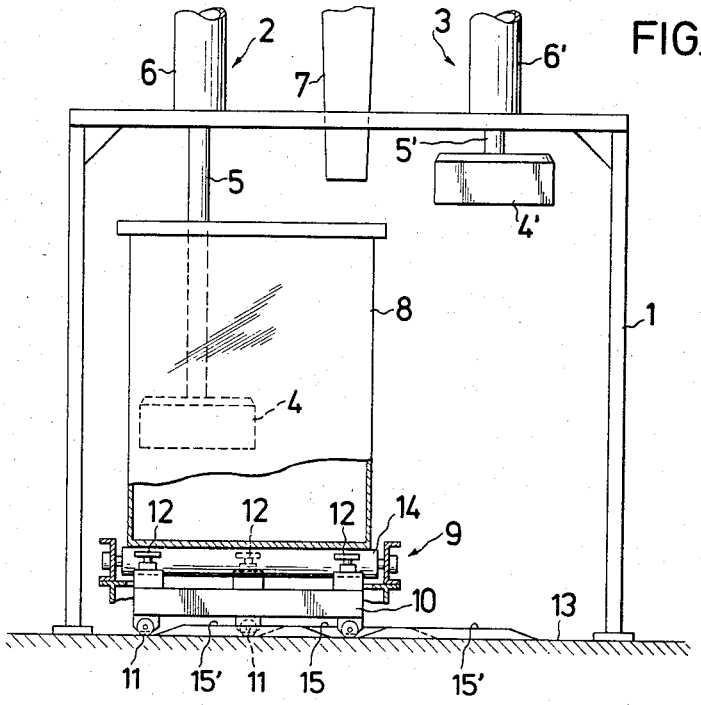
FIG. 1 is a side view of the depositing and pressing apparatus in which the container is in one end position of the traversing movement.

FIG. 1 illustrates a tow-depositing and pressing apparatus in a side view. This apparatus consists of a stand 1 with two press devices 2 and 3. Each press device consists of a press ram 4, 4', each on a piston rod 5, 5', and of a pneumatic drive 6, 6'. The tow material runs via a pivotable chute 7 into a container 8 which is carried by a traversing device 9. Guided along in the traversing device 9 is a weighing platform 10 which can be moved vertically independently of the traversing device 9. The weighing platform 10 runs on rollers 11 and carries weighing devices 12.

In FIG. 1, the container 8 and consequently the traversing device 9 are shown in one end position of the traversing movement, in which the press device 2 is activated and the press ram 4 compresses the tow (not shown) deposited in the container 8. The weighing platform 10 is in its lower position. The rollers 11 carrying it move on the baseplate 13. Because of this lower position of the weighing platform 10, the weighing devices 12 do not touch the container 8. On the contrary, the container 8 is carried by the transport rollers 14 of the traversing device 9.

Figure 2:
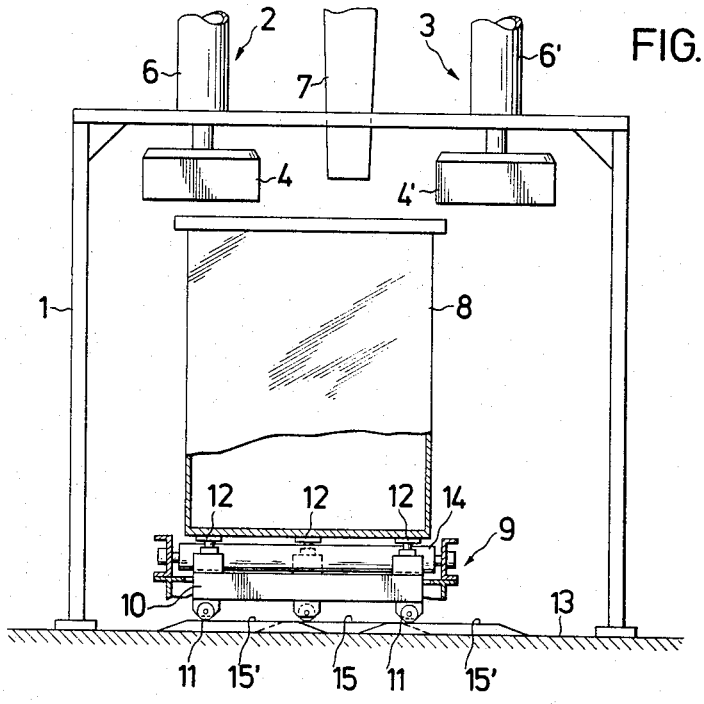
FIG. 2 is, again, a side view of the apparatus as in FIG. 1, but the container is between the end positions of the traversing movement.
Figure 3:
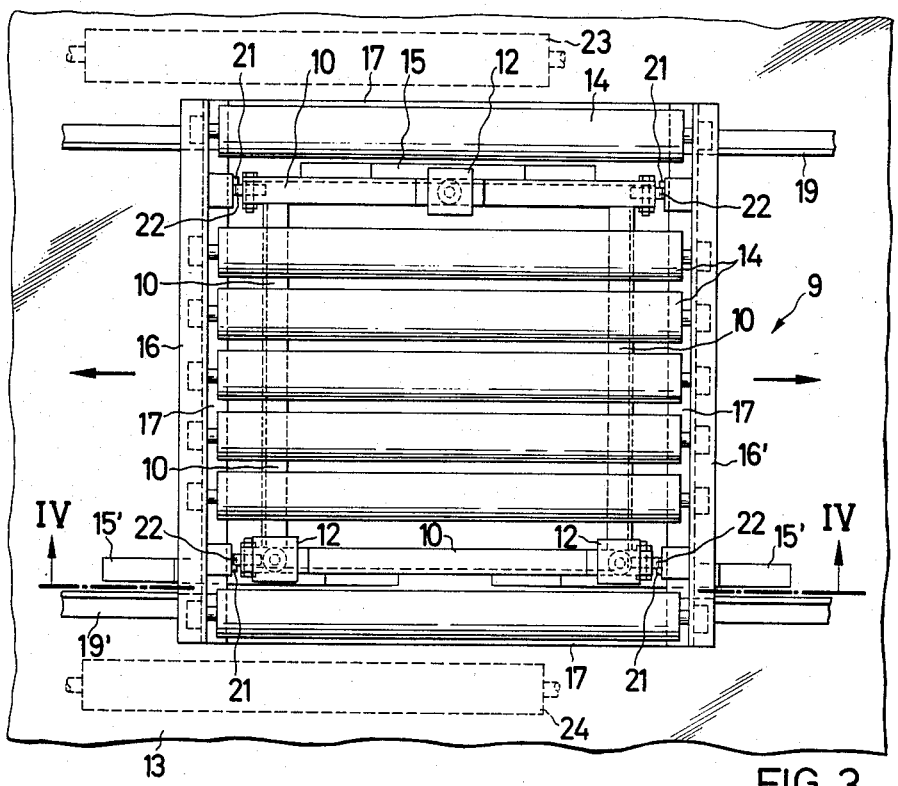
FIG. 3 shows a plan view of the traversing device with a weighing platform.
Figure 4:
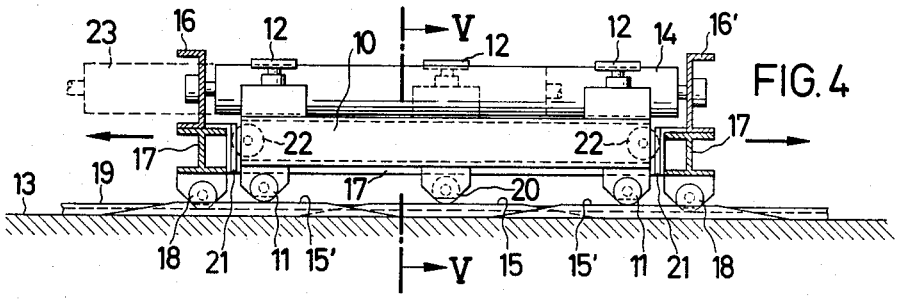
FIG. 4 illustrates a section along the plane IV—IV in FIG. 3.
Figure 5:
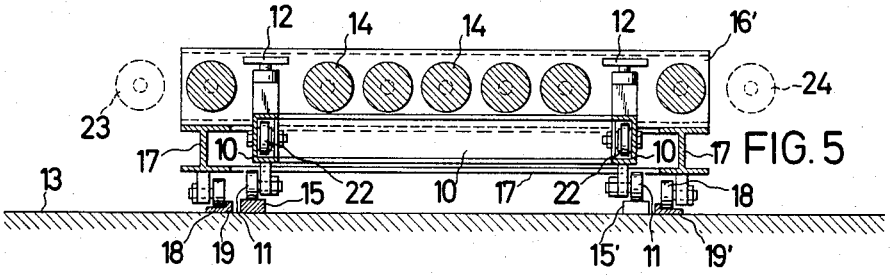
FIG. 5 shows a further sectional view along the plane V—V in FIG. 4.

FIG. 2 illustrates the same apparatus, but the container 8 has left the traversing end point according to FIG. 1 and is on its way to the other end point. During this movement of the container and of the traversing device 9, the weighing platform 10 is driven onto ramps 15, 15' by means of its rollers 11. The weighing platform has been lifted as a result and now carries the container 8 by means of the weighing devices 12. The container 8 no longer touches the transport rollers 14. The weighing devices 12 are preferably load cells which emit an electrical signal which is proportional to the force exerted and which is processed in a central switching and control unit (not shown). Details of the construction of the weighing platform in the traversing device are shown in FIGS. 3 to 5. FIG. 3 shows a plan view of the traversing device 9 with a weighing platform 10, FIG. 4 shows a cross-section through the traversing device 9 and weighing platform 10 along the plane IV—IV in FIG. 3, and FIG. 5 shows a cross-section along the plane V—V according to FIG. 4. The transport rollers 14 of the traversing device 9 can be seen in all three Figures. These transport rollers are held by beams 16, 16' ahd a frame system 17. The transport rollers 14 are conventionally driven via chain drives. These drives have not been pictured in the Figures. The traversing movement of the traversing device 9 takes place by means of a drive (not shown), the traversing device 9 being moved on rollers 18 which are guided in a rail system 19, 19'. A weighing platform 10 guided along with the traversing device 9 has the form of a frame and is supported on the baseplate 13 via rollers 11. The weighing platform 10 touches only at 4 points the frame 17 of the traversing device 9 surrounding it. These contact points are made especially mobile by the use of ball bearings 22. These ball bearings, when in contact with corresponding guides 21 in the frame system 17 of the traversing device 9, ensure that the weighing platform can follow the traversing movement of the traversing device 9, but the height of the weighing platform 10 can be adjusted independently of the traversing device 9.

In FIGS. 3 to 5, the weighing platform 10 carries three weighing devices 12 under each of which a roller 11 for the weighing platform is located. The level of the weighing platform and consequently also of the load cells 12 is determined by whether the rollers 11 are located on the baseplate 13 at the normal level or on the ramps 15, 15'. In FIGS. 3 to 5, the weighing platform is just located on the ramps 15, 15' by means of its rollers 11. For this reason, the weighing devices 12 project above the height of the transport rollers 14. In this position of the weighing platform, a container would be carried by the weighing devices 12 only.

Two further transport rollers are indicated in FIGS. 3 to 5. They bear the numbers 23 and 24 and are parts of transport devices for transporting the empty containers into the depositing and pressing apparatus and for transporting the full containers out of this apparatus. The feeding and removal of containers appropriately take place in an end position of the traversing movement. This ensures that damage to the weighing devices 12 cannot occur during the transport of the containers.

Figure 6:
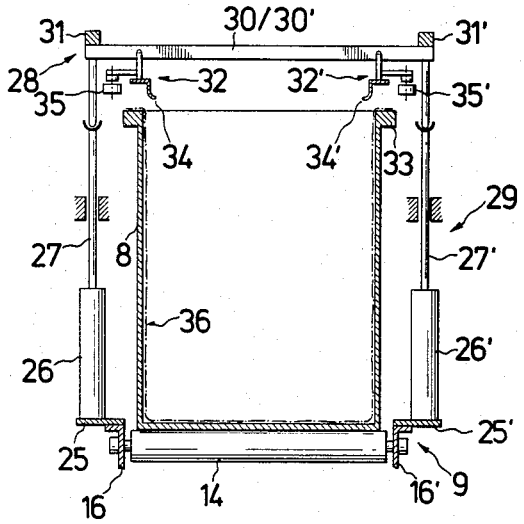
FIG. 6 shows a side view or section of the holding frame and supporting device with the supporting device lifted.
Figure 7:
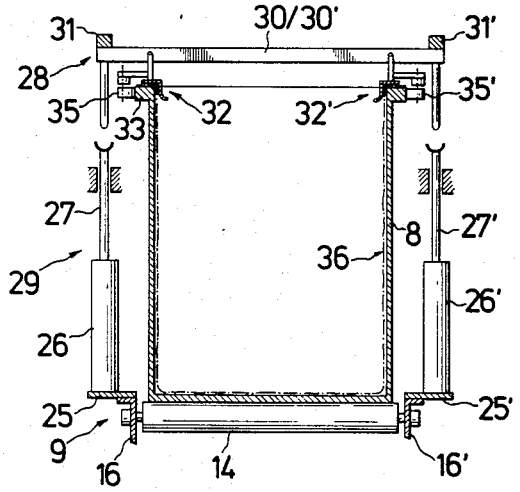
FIG. 7 shows a side view as in FIG. 6, but here the supporting devices are lowered and the holding frame rests on the edge of the container.

FIGS. 6 and 7 show cross-sections of the container 8 and of the traversing device 9 with transport rollers 14 and beams 16, 16'. Pneumatic drives 26, 26' carrying a holding frame 28 via piston rods 27, 27' are arranged on these beams 16 and 16' via small pedestals 25, 25'. The system of pneumatic drives 26, 26' with the associated piston rods 27, 27' is also referred to in the Application as supporting devices 29. The actual holding frame 28 consists of the frame rods 30, 30' and 31, 31'. Two clamping devices 32, 32' are shown on this holding frame 28. FIG. 6 illustrates the position of the supporting devices 29 when the container 8 is transported into the depositing device or out of it by means of the transport-roller systems 14 and 23 or 24 (not shown). As soon as the container 8 has reached its position in the depositing and pressing apparatus, the supporting device 29 can be introduced. Under these conditions, the holding frame 28 comes to rest on the edge 33 of the container 8. By means of the clamping devices 32, 32', clamping rails 34, 34' are pressed against the edge 33 by means of cams 35, 35'. Under these conditions, a box-shaped bag 36 consisting, for example, of packaging sheet can be retained against the edge 33 of the container 8 in such a way that the box-shaped bag 36 cannot be shifted in the container 8 even when the press rams 4 or 4' are lowered.

It is evident from FIG. 7 that in the working position the holding frame 28 is no longer connected to the supporting devices 29. During weighing, the weight of the holding frame 28 is included in the determination of the tare. The clamping devices 32, 32' are actuated via the cams 35, 35' by means of movement devices which are not shown. The holding frame also has the function of carrying the catch box, for example according to FIGS. 8 to 10.

Figure 8:
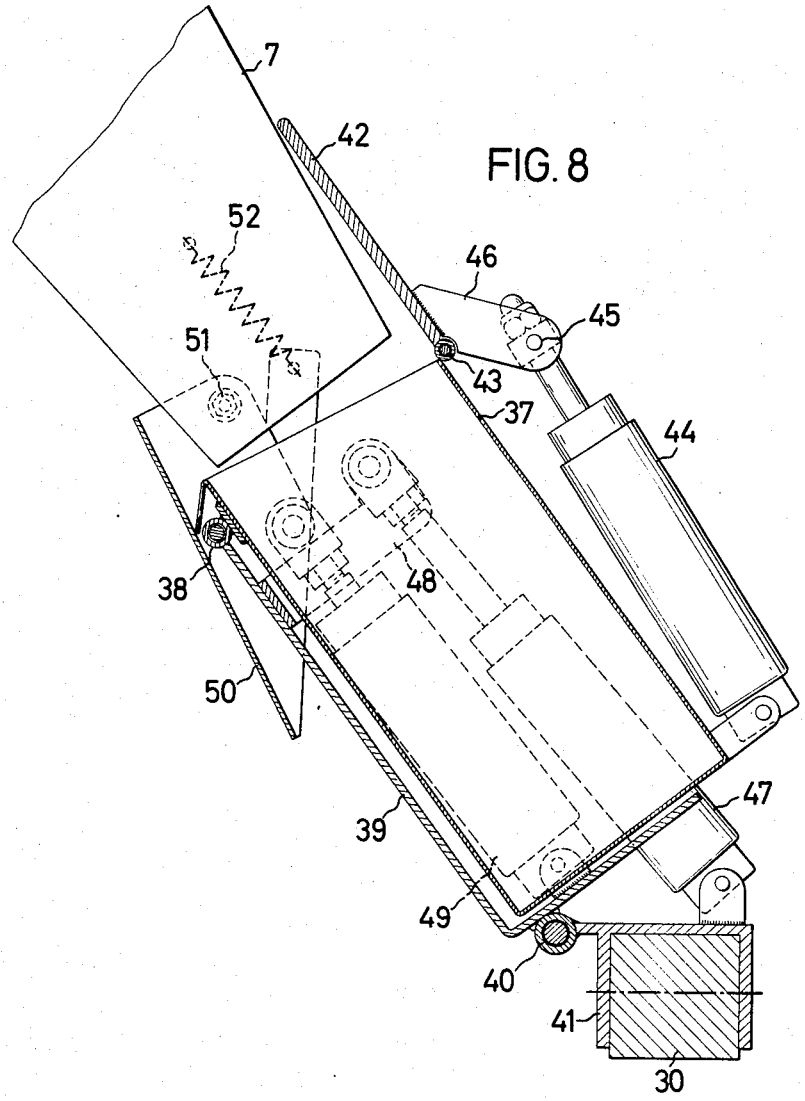
FIG. 8 shows a catch box and chute in cross-section in the transfer position.
Figure 10:
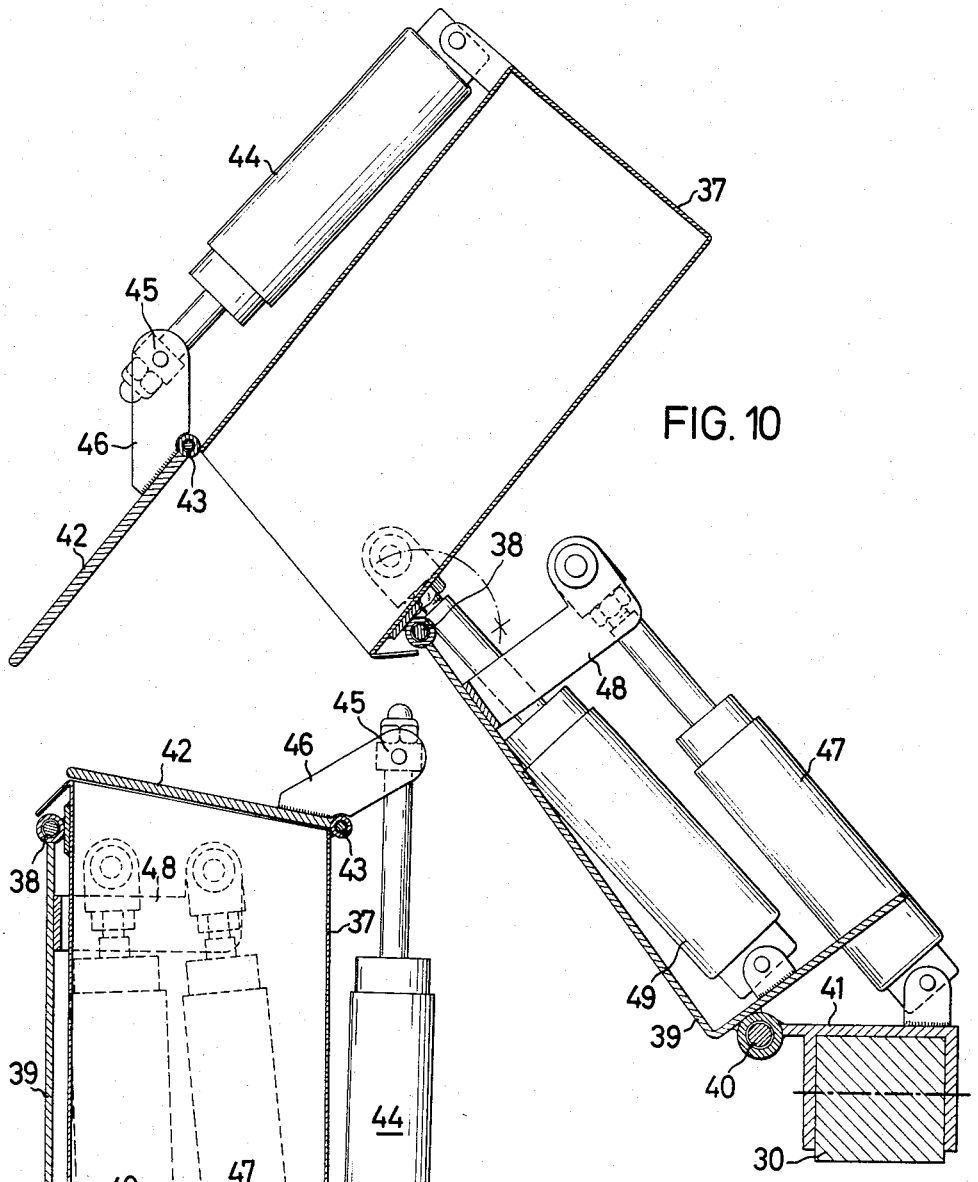
FIG. 10 shows the same catch box in the ejection position.
Figure 9:
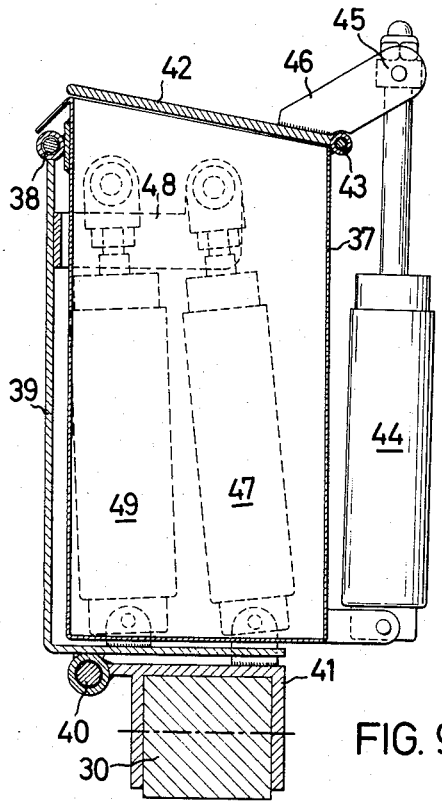
FIG. 9 shows a corresponding catch box in cross-section in the working position.

A possible design of the catch box is illustrated in FIGS. 8, 9 and 10 which each show a cross-section of this catch box in a different working position. The catch box consists of a housing 37 connected via a hinge 38 to an angle support 39. This angle support 39 is connected, in turn, to a fastening device 41 via a hinge 40. This fastening device 41 makes the connection to the frame rod 30 of the holding frame. The catch box also has a cover 42 connected to the housing 37 via a hinge 43. The catch box of FIGS. 8 to 10 includes three movement devices which can be actuated pneumatically via connections (not shown). The actuating drive 44 serves for opening and closing the cover 42. For this reason, the piston rod is connected via a mounting 45 to the lever 46 which is itself firmly connected to the cover 42. When the piston rod of the actuating drive 44 is retracted, the cover 42 is opened. The cover can be seen in the open position in FIGS. 8 and 10. A further actuating drive 47 allows the angle support 39 to pivot about the hinge 40. The piston rod of the actuating drive 47 acts on a lever 48 firmly connected to the angle support 39. In FIGS. 8 and 10, this actuating drive is extended, and the angle support 39 therefore stands at an angle in space, whereas in FIG. 9 the drive 47 is retracted, and the angle support 39 stands vertically in space.

A further actuating drive 49 acts between the angle support 39 and the housing 37. When this actuating drive is actuated, it is possible to pivot the housing 37 in a wide arc about the hinge 38, as shown in FIG. 10.

FIG. 8 illustrates the so-called transfer or catching position of the catching container. Because the actuating drive 47 is actuated, the catching container stands obliquely in space in the direction of the pivotable chute 7. The cover 42 of the catching container is open. The pivoting chute 7, which has a movable skirt 50 mounted movably at two points 51 and connected to a spring 52, is likewise located in the transfer position. If the start of a tow runs through the chute 7 into the catch box, measuring devices (not shown), for example light barriers, ensure that the chute 7 is swung back again and the cover 42 is closed. As a result of these measures, the start of the tow is blocked in the housing 37. To prevent unintentional contact or obstruction of the chute during its depositing operation, the catch box must be moved back into its vertical position by actuating the actuating drive 47. The catch box remains in this working position during the entire depositing operation. After the filling of the container 8 has been completed, the start of the tow has to be placed on top of the deposited tow material. This is carried out by simultaneously actuating the actuating drives 44, 47 and 49. As a result, the cover 42 opens and the container 37 shoots obliquely upwards and drops the released start of the tow onto the deposited tow material in the container.

It is necessary to ensure that when the start of the tow is ejected into the full container 8 it does not come to rest next to the container or over the edge 33 of the container 8. For this reason, it is advantageous to make the chute 7 according to FIGS. 1 and 2 swing not only forwards and backwards in a plane between the rams 4, 4', but also in a second plane shifted in the direction of the press ram 4. Such a pivoting of the chute 7 is easily possible by providing a suitable additional hinge and appropriate movement devices. Such an inclined position of the chute also means that the catch box is no longer fastened at one corner of the container 8 to a frame rod 30 or 30' of the holding frame 28, but is appropriately offset in the direction of the press ram 4 according to the shift of the chute into a second plane and is fastened to the edge or to the holding frame 28. By means of this measure it is possible to ensure that the start of the tow is thrown out of the catch box onto the deposited material and not over the edge of the container 8.

The function of the spring-mounted skirt 50 of the chute 7 is to guarantee that the tow is deposited in the container 8 as uniformLy as possible. At the same time, it serves to provide a seal when the start of the tow is transferred from the chute into the catching container.

FIGS. 11 to 14 illustrate diagrammatically a cable-cutting and fixing device which operates automatically. Such a cutting device must be located in front of the pivotable chute 7. The tow 58 consisting of crimped filaments is generally delivered on a conveyor belt 53 and runs through the orifices in the clamping device 54. As can be seen from the side view of FIG. 11 and the plan view of FIG. 12, the clamping device 54 consists of fixed metal parts 55 having a V-shaped orifice and of appropriately shaped movable metal parts 56 likewise having a V-shaped cut-out. The movable parts 56 can be moved in the direction of the fixed metal parts 55 via a movement device 57. The tow coming from the conveyor belt 53 runs through the V-shaped orifices of the parts 55 and 56 into the chute 7 (not shown here). When the tow feed is stopped, the movement device 57 is actuated and the tow 58 is clamped in the V-shaped cutouts in the metal parts 55 and 56. It is evident from FIG. 11 that four clamping points are obtained. In addition, tow supports 59 having approximately the same inside shape as the parts 56 are attached to the movable metal parts 56. FIG. 13 shows in a plan view the compressed state of the tow 58.

The tow 58 can be severed by means of a rotating knife 60 which can be moved in the direction of the tow 58 via a movement device 61. At the same time, the supports 59 ensure that the tow cannot escape from the action of the rotating knife 60.

Wrapping with a yarn or an adhesive tape or the like is also necessary to fix the individual filaments of the tow ends produced. FIGS. 11, 12 and 14 show such fixing devices which, by using two adhesive tapes each, ensure that the individual filaments are fixed. It is evident from FIG. 11 that two of these fixing devices are necessary to fix the tow ends which result or have resulted. In particular, such a fixing device 62 or 62' consists of two adhesive tapes 63/63'', 63'/63''' which can be unwound from appropriate supply rolls 64/64'', 64'/64'''. The adhesive tapes 63/63'', 63'/63''' are glued to one another at the points 65, 65'. After the clamping device 54 has been moved together, the fixing devices 62, 62' can be moved in the direction of the clamped tow as a result of the actuation of an actuating drive 66. The tow 58 or tow ends are thereby enveloped by the adhesive tapes 63/63'', 63'/63''' and, when the actuating drives 67, 67' are actuated, are pressed onto the compressed tow as a result of the movement of the scissor-shaped parts 68/69, 68'/69' and severed. The parts 68, 68' exhibit a deformation corresponding to that of the final tow, and in the corresponding parts 69, 69' this portion is spring-mounted. When the actuating drives 67, 67' are moved apart from one another, the adhesive tapes are first pressed onto one another and onto the tow and only during the further action of the actuating drives 67, 67' are severed by means of the knives 70, 70'. As a result of this measure, each tow end is surrounded by adhesive tapes which ensure that the individual filaments of the tow ends cannot separate from one another. After the clamping device 54 has been released, one tow end will drop through the chute 7 into the already full container 8, whilst the upper tow end remains in the device, with the conveyor belt 53 stationary, but jumps back because of the reduced tension. It is therefore possible to draw the fixing device past the tow by actuating the actuating device 66. The severed adhesive tapes have new places 65, 65' at which they are joined together. The tow which initially remains in the cutting and fixing device when the conveyor belt 53 is stationary can then be guided into the catching device via the chute 7 after the full container 8 has been removed and replaced by an empty one. This tow end then represents the start of a tow for the next depositing operation. It is appropriate, in order to identify the various tow ends, to use, for example, differently marked or lettered adhesive tapes. It is thereby possible, in a simple way, to define clearly the end of the tow and start of the tow in each container.

A plurality of switching elements and the like connected to a central switching unit is of course necessary for automatic operation. However, the explanation of the apparatus according to the invention has substantially omitted these, so as not to impair the clarity of the description and also the clarity of the Figures. The individual working steps must, of course, be monitored by light barriers, limit switches and the like, and it is necessary to ensure, in a central switching unit, that a predetermined cycle of individual working steps is guaranteed.

I claim:

1. In a process for depositing and pressing continuous tows in which a continuous tow is deposited in zigzag layers into an open-ended container through a pivotable chute, moving a container transversely to the chute by means of a traversing device, and exposing the deposited tow to the effect of respective press rams at each end point of the traversing movement, the improvement comprising the steps of introducing an empty container onto the traversing device, transferring the starting end of a continuous tow to a catch box positioned adjacent the open-ended empty container, weighing the container and its contents during each traversing movement thereof, stopping the further deposition of the continuous tow into the container when a predetermined tow weight is reached, severing the tow and fixing the tow ends thus formed by the sever to prevent them from unraveling, depositing the starting end of the continuous tow from the catch box into the open-ended container after the severing and fixing steps, and removing the open-ended container and its tow contents from the traversing device.

2. A process as in claim 1 including the step of lifting the container and its tow contents slightly upwardly away from the traversing device during each weighing step.

3. A process as in claim 1 including the steps of introducing packaging material into an open-ended empty container prior to depositing tow therein, and releasably clamping the packaging material to the container to hold it in place next to the container during deposition of the continuous tow therein.

4. In a tow-depositing device for depositing and pressing tows into open-ended portable containers comprising a traversing device for moving a transportable container back and forth between two end positions, two press rams located above the transportable container at the end positions of its traverse movement constructed and arranged to compress the tow material deposited in the container, a pivotable chute located between the press rams for feeding a continuous tow into the container, and means for loading empty containers onto the traversing device and filled containers away from the traversing device, the improvement according to which the tow-depositing device includes a weighing platform with weighing means thereon located within the traversing device constructed and arranged to follow the movement of the traversing device and also to raise independently of the traversing device whereupon the container is lifted and weighed by the weighing means, a holding frame movable within the traversing device for releasably securing packaging material within the container, a catch box movably mounted on the holding frame constructed and arranged to catch and hold the starting end of a continuous tow and to deposit such end into the container upon completion of tow deposition into the container, a tow-cutting and fixing device connected to cut the tow upon completion of tow deposition into the container and to fix the thus formed severed tow ends whereby individual filament ends of the tow are prevented from unraveling.

5. A tow-depositing device as in claim 4 wherein the weighing platform includes roller means on the underside thereof, and ramp means over which the roller means move as the traversing device moves back and forth between its two end positions, the ramp means being arranged to raise the weighing platform independently of the traversing device whereupon the container is weighed by the weighing means.

6. A tow-depositing device as in claim 4 wherein the holding frame includes clamping devices for retaining upper edge portions of packaging material against edge portions of the container defining the opening thereof.

7. A tow-depositing device as in claim 4 wherein the tow-cutting and fixing device includes a rotating tow knife and two fixing devices, one positioned above and the other below the tow knife, each fixing device having two rollers of tape, and means for wrapping the tape around the tow.

* * * * *